United States Patent [19]

Tillman

[11] 4,362,072

[45] Dec. 7, 1982

[54] WRENCH

[76] Inventor: Jerry W. Tillman, 2209 Sybel Dr., Mobile, Ala. 36609

[21] Appl. No.: 174,586

[22] Filed: Aug. 1, 1980

[51] Int. Cl.[3] ..... B25B 17/00

[52] U.S. Cl. ..... 81/57.29; 81/57.13

[58] Field of Search ..... 81/57.13, 57.14, 57.29, 81/57.3, 57.39, 58.1, 60–63.2

[56] References Cited

U.S. PATENT DOCUMENTS

| | | | |
|---|---|---|---|
| 1,123,612 | 1/1915 | Starks | 81/61 |
| 1,281,484 | 10/1918 | Bellows | 81/61 |
| 1,346,716 | 7/1920 | Lee | 81/57.29 |
| 1,416,271 | 5/1922 | Devos | 81/57.29 |
| 2,938,415 | 5/1960 | Kostka | 81/57.29 |
| 4,031,784 | 6/1977 | Cobbe | 81/57.39 |

FOREIGN PATENT DOCUMENTS

| | | | |
|---|---|---|---|
| 2918825 | 11/1980 | Fed. Rep. of Germany | 81/60 |

*Primary Examiner*—James L. Jones, Jr.

[57] ABSTRACT

A wrench including a handle portion and a wrench head that comprises an insertable flat disk containing an aperture therein for receiving a nut or the head of a bolt and, which further includes a rotatable drive shaft and a series of gears to provide rotation of the disk for turning the nut. The wrench is designed to be used in places where very little room is provided for turning a manual box or open-ended wrench in the necessary side-to-side motion. The wrench of the present invention including the flat nut turning disk is devoid of any protruding components such as is standard in the conventional socket wrenches.

7 Claims, 6 Drawing Figures

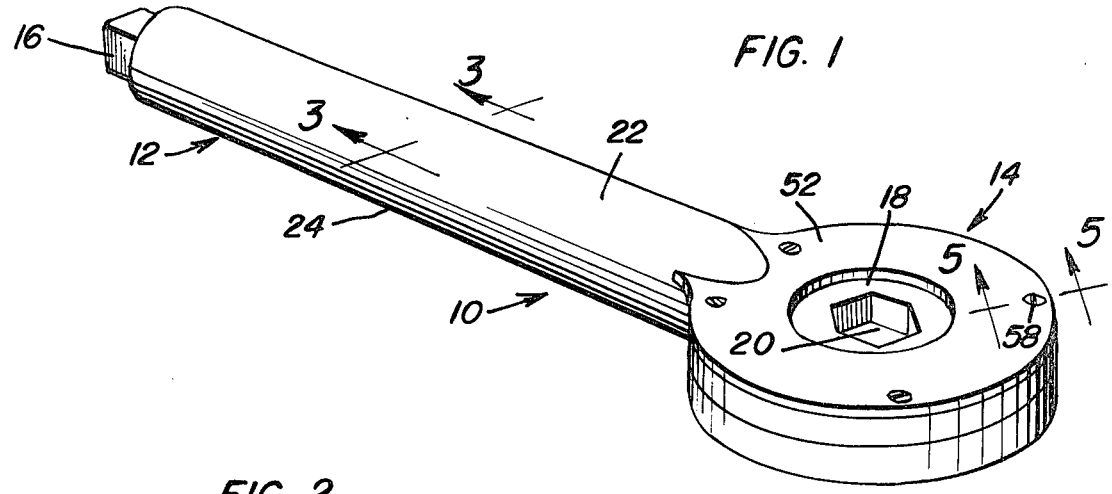
FIG. 1
FIG. 2
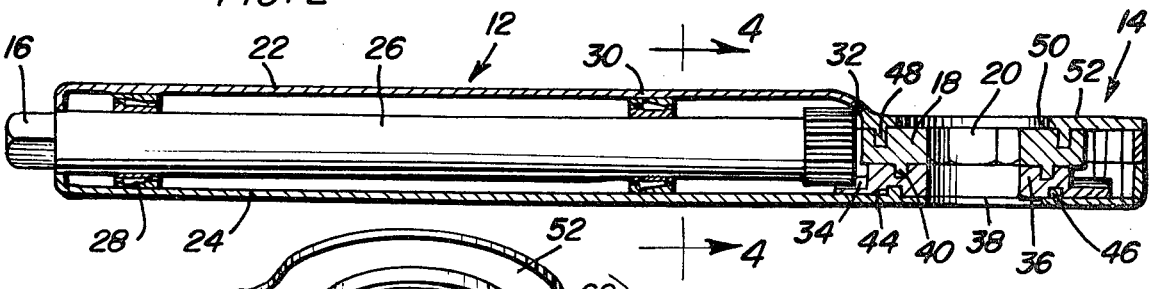
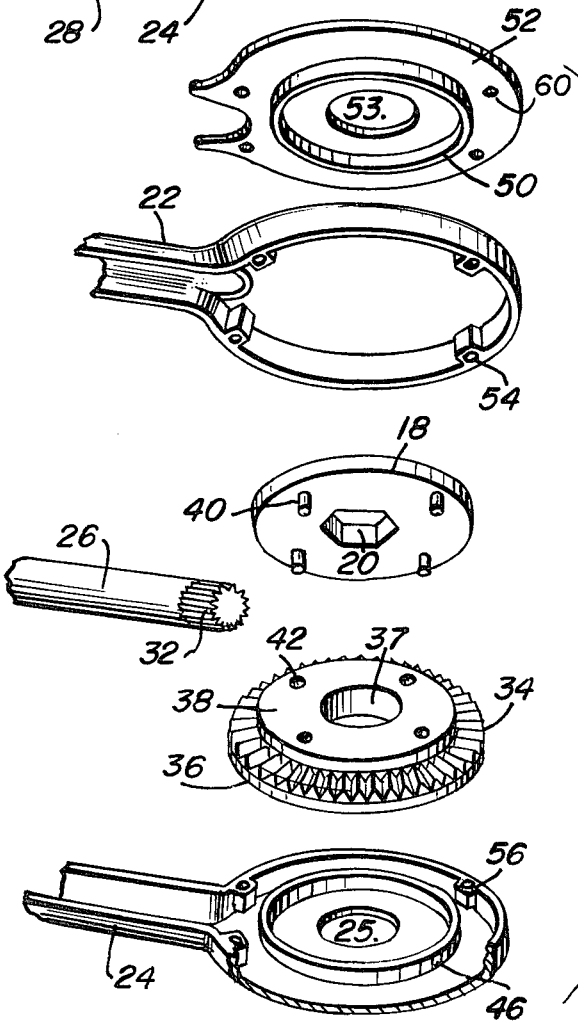
FIG. 3
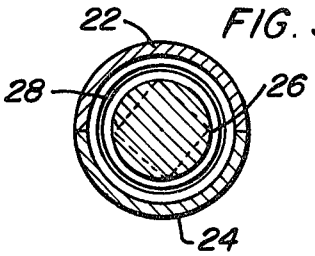
FIG. 6
FIG. 5
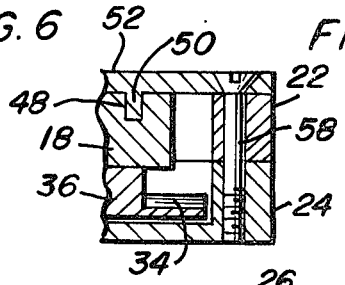
FIG. 4
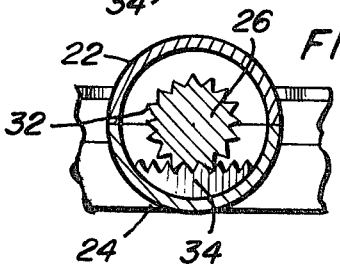

WRENCH

BACKGROUND OF THE INVENTION

1. Field of the Invention

This invention relates in general to wrenches and specifically to wrenches which are operable by rotation of a shaft inserted in the handle of the wrench.

2. Disclosure Statement

There have been many improvements to the conventional box or open end wrench in order to provide for quick tightening and loosening a nut or bolt in those instances where the wrench handle movement is limited to only a small arc. Such improvements include ratchet wrenches which are very well-known in the art. A conventional ratchet wrench includes a structure whereby oscillation of the handle of the wrench will cause rotation of the head of the wrench for driving an associated socket member or the like. Typically, the wrench head axis is transverse to the wrench handle. The handle oscillation mode of operation is very fast compared to a box or open end wrench, particularly in those instances where limited space is available for wrench handle movement and where other types of wrenches will not reach. It is equally well-known, however, that even ratchet wrenches are somewhat difficult to use in applications where oscillation of the handle is limited. More recently, speed ratchets have been developed to overcome the limitations of conventional ratchet wrenches. Such wrenches are provided with means associated with the handle whereby rotary movement may be imparted to the head of the wrench independent of oscillation of the handle, operation of the wrench being accomplished by rotation of the shaft of the wrench about the longitudinal axis of the handle instead of by the conventional oscillating of the handle. Many patents have been granted on such type of rotary handle ratchet wrenches, each patent providing a different solution to the various problems associated with the wrench structure. Several of these patented wrenches as listed as follows:

U.S. Pat. No. 2,808,749—Oct. 8, 1957—Lampke
U.S. Pat. No. 3,272,037—Sept. 13, 1966—Bruehl
U.S. Pat. No. 3,707,893—Jan. 2, 1973—Hofman
U.S. Pat. No. 3,733,936—May 22, 1973—Flynn
U.S. Pat. No. 4,086,829—May 2, 1978—Hudgins
U.S. Pat. No. 4,137,801—Feb. 6, 1979—Imperio.

Typically, all of the above patents utilize protruding sockets for turning the nut or bolt, and include complex structures not required by the present invention.

SUMMARY OF THE INVENTION

The present invention provides for a wrench which is useful for quickly tightening and loosening a nut or bolt, particularly in applications where other types of wrenches will not reach. In accordance with the present invention, a flat nut turning disk is inserted in the wrench head for rotation by a gear disk which is turned by a matching drive gear situated on a rotating shaft placed axially through the handle of the wrench. The drive shaft is rotated about the longitudinal axis of the handle of the wrench. The nut disk includes an aperture at the center, the aperture having a size to fit a particular nut or bolt. The nut disk can be replaced by disks containing apertures of other sizes, similar to the conventional ratchet wrenches which use sockets of varying size. The use of the flat nut turning disk and the operation of the wrench by the rotation of the drive shaft about the longitudinal axis of the handle enables the wrench of the present invention to be used in places where box and open end wrenches are not able to be operated and even in places where the protruding socket of a ratchet wrench cannot be positioned around the nut or bolt.

Accordingly, it is an object of the present invention to provide a wrench which can be used in places where other conventional wrenches will not reach.

It is another object of the invention to provide a wrench in which the head of the wrench includes a nut turning disk which is rotated by a rotating drive shaft along the length of the handle of the wrench.

It is still another object of the invention to provide a wrench in which the head of the wrench includes an insertable nut turning disk which can be replaced to accommodate nuts and bolts of different sizes and which is rotated by the rotation of a drive shaft positioned along the longitudinal extent of the wrench handle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view illustrating the completely assembled wrench of the present invention.

FIG. 2 is a longitudinal cross-sectional view of the wrench of the present invention, the main drive shaft being shown in elevation.

FIG. 3 is a transverse sectional view of the handle of the wrench taken generally along section line 3—3 of FIG. 1.

FIG. 4 is a transverse sectional view of the handle of the wrench taken generally along section line 4—4 of FIG. 2.

FIG. 5 is a fragmented transverse sectional view of the head of the wrench taken generally along section line 5—5 of FIG. 1.

FIG. 6 is a fragmented exploded perspective view of the wrench illustrating the components which form the head of the wrench of the present invention.

DETAILED DESCRIPTION OF THE INVENTION

The wrench of the present invention is similar to box wrenches in which the aperture for insertion about the nut or bolt to be moved is enclosed by the head of the wrench. Referring to FIG. 1, the wrench of the present invention is designated by the reference numeral 10. Wrench 10 includes an elongated handle 12 and wrench head 14. Wrench 10 is different from the conventional box wrench which is operated by manual movement of the wrench handle, in that wrench 10 of the present invention includes a rotating drive 16 placed at the end of handle 12. Rotation of rotating drive 16 can be effected by many means including hand driven means, electric and pneumatic motors, and the like (not shown). Secured within wrench head 14 is a circular rotating nut disk 18 which includes aperture 20 for placement over the nut or bolt which is to be turned. Rotation of rotating drive 16 in either direction about the longitudinal axis of handle 12 produces the proper rotation of nut disk 18 for quickly tightening or loosening a nut or bolt.

FIGS. 2 and 6 illustrate the details of wrench 10 and provide understanding of the operation of the present invention. The moving components of wrench 10 are enclosed in top housing 22 and bottom housing 24, the assembled housing halves forming handle 12 and the outer periphery of head 14. Placed axially along handle 12 is drive shaft 26 which rotates about the longitudinal axis of handle 12. At the end of drive shaft 26 is rotating drive 16 which is illustrated as a square drive. Shown in FIG. 2 is optional roller bearings 28 and 30 placed over drive shaft 26. On drive shaft 26 at the end opposite that containing rotating square drive 16 is drive gear 32 which meshes with gear teeth 34 formed on circular gear disk 36 placed in wrench head 14. Circular rotating nut disk 18 is secured to support plate 38 of gear disk 36 by placement of studs 40 located on the bottom of nut disk 18 within holes 42 placed about the top portion of support plate 38. The attachment of nut disk 18 to gear disk 36 enables nut disk 18 to be rotated for turning a nut or bolt which can fit aperture 20. In accordance with the present invention, it is possible to provide a plurality of nut disks 18, each with a different size aperture 20, the size of the nut or bolt which is to be turned can be matched with the appropriate nut disk which is then inserted in head 14 for connection with gear disk 36.

Operation of wrench 10 can be clearly determined from inspection of FIGS. 2 and 3. Nut disk 18 secured to gear disk 36 is rotated along with gear disk 36 by the rotation of drive gear 32 which is meshed with gear teeth 34 during the rotation of drive shaft 26 through rotating drive 16 and a drive motor (not shown). Gear disk 36 contains a continuous circular groove 44 which meshes with track 46 placed on bottom housing 24 to maintain uniform rotation of gear disk 36 within head 14, the sides of circular groove 44 moving relative to track 46. Nut disk 18 contains circular groove 48 which meshes with circular track 50 formed on cover 52, the intermeshing relationship between groove 48 and track 50 further guiding the rotation of nut disk 18. Bottom housing 24 and cover 52 contain circular apertures 25 and 53, respectively, corresponding with aperture 20 in nut disk 18. Gear disk 36 also contains aperture 37 therethrough, apertures 25, 37 and 53 enabling either side of wrench head 14 to accommodate the nut or bolt to be turned. In operation, a motor, or the like, is secured to rotating square drive 16, the rotation of drive 16 in either direction rotating drive shaft 26 and attached drive gear 32. Rotation of drive gear 32 about the longitudinal axis of handle 12 rotates gear disk 36 and associated gear teeth 34 about the circumference of head 14, the rotation of gear disk 36 being guided by intermeshing groove 44 and track 46. Nut disk 18 being secured to gear disk 36 by studs 40 placed through holes 42 on support plate 38 rotates with gear disk 36, aperture 20 rotating about the central axis of head 14, turning the nut or bolt upon which wrench head 14 is placed.

Wrench 10 can be easily assembled and conveniently used since nut disk 18 can be inserted and removed to accommodate various nut and bolt sizes. Assembly of wrench 10 encompasses placing gear disk 36 on bottom housing 24 so that groove 44 on gear disk 36 meshes with track 46 placed on bottom housing 24. Drive shaft 26 containing drive gear 32 is positioned so that the teeth of drive gear 32 intermesh with gear teeth 34. A nut disk 18 containing the appropriately sized aperture 20 is then snapped into place on support plate 38 of gear disk 36. Top housing 22 is then placed over the assembled gear disk and drive shaft so that lugs 54 on housing 22 are in alignment with lugs 56 on housing 24. Lugs 54 and 56 contain threaded through holes to receive screws 58 placed through hole 60 on cover 52, screws 58 being threaded into each lug 54 and 56 outside the periphery of gear teeth 34 as shown in FIG. 5. Circular track 50 on cover 52 interlocks with circular groove 48 of nut disk 18. To replace nut disk 18 with a disk having an aperture 20 of a different size, screws 58 are removed, cover 52 is lifted and nut disk 18 is removed and a new one snapped into place on support plate 38. Cover 52 is then replaced and secured to housing pair 22 and 24.

The assembly of cover 52 to housing pair 22 and 24 can be modified so that the housing pair does not have to be disconnected each time nut disk 18 is to be replaced. Further, gear drive 32 and gear teeth 34 can be straight or beveled gears, depending upon the use of wrench 10. Wrench 10 of the present invention is an improvement over conventional manually operated box, open end and ratchet wrenches and even ratchet wrenches which are power driven since the flat nut disk 18 does not protrude from the longitudinal axis of the wrench and can therefore be used in places where the other types of wrenches cannot reach. The rotating drive of the wrench from handle 12 also eliminates the need of any manually oscillating motion, thus providing a big advantage in places where wrench handle movement is limited only to a small arc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wrench containing an elongated handle and a head, said head comprising a rotatable flat disk containing an aperture therein for engaging a nut or bolt head, a housing enclosing the rotatable disk for rotation thereof relative to the housing, a gear disk connecting with said rotatable disk within the housing and containing gear teeth about a periphery thereof, an elongated drive shaft positioned through said handle and terminating at one end at a point beyond said handle to be engaged by a rotating means and terminating at another end in a rotatable gear drive means containing gear teeth which intermesh with said gear teeth on said gear disk, said gear drive means being rotatable about a longitudinal axis of said handle and about a line perpendicular to a rotating axis of said gear disk with its connecting rotatable disk, said gear disk with its connecting rotatable disk being of circular shape having the gear teeth of said gear disk being contained within a uniform strip forming the circumference of said gear disk, said gear disk including a circular plate positioned within the circumference of said gear teeth, said plate containing a plurality of apertures, said rotatable disk including a plurality of posts positioned thereon to match the positions of said apertures on said plate, said rotatable disk being secured to said gear disk by the insertion of said posts in said apertures.

2. The wrench of claim 1 wherein said housing includes an aperture positioned in a matched relation with the aperture on said rotatable disk, said gear disk including an aperture therethrough matched with the aperture on said rotatable disk so that the head of said wrench can be placed over a nut or bolt for contact with said aperture in said rotatable disk.

3. The wrench of claim 2 wherein said housing is divided into an upper half and lower half, said lower half includes a protruding circular track, said gear disk includes a circular groove to interlock with said track at a position opposite said support plate, said upper half includes a cover containing a protruding circular track, said rotatable disk including a circular groove for interlocking arrangement with said protruding track on said upper half, the circular grooves of said rotatable disk and said gear disk moving relative to said tracks on said housing halves.

4. The wrench of claim 3 where each of said halves includes an aperture therein in matching position relative to said aperture in said rotatable disk.

5. The wrench of claim 1 wherein said aperture is hexagonal.

6. The wrench of claim 1 wherein the configuration of the rotating means is square.

7. The wrench of claim 1 wherein the rotatable disk is replaceable with rotatable disks having different sized apertures.

* * * * *